United States Patent [19]

Meyers

[11] 4,102,457

[45] Jul. 25, 1978

[54] CARTONS FOR ICE CREAM AND THE LIKE

[75] Inventor: George Leroy Meyers, Menasha, Wis.

[73] Assignee: American Can Company, Greenwich, Conn.

[21] Appl. No.: 808,182

[22] Filed: Jun. 20, 1977

[51] Int. Cl.[2] ..... B65D 5/54

[52] U.S. Cl. ..... 206/611; 206/624; 206/629

[58] Field of Search ..... 206/611, 624, 629, 621, 206/625, 626; 229/33, 36, DIG. 9

[56] References Cited

U.S. PATENT DOCUMENTS

| | | | |
|---|---|---|---|
| 1,143,745 | 6/1915 | Bloomer | 229/33 |
| 3,003,674 | 10/1961 | Ringler | 229/33 |
| 3,265,285 | 8/1966 | Fanter | 206/611 |
| 3,833,165 | 9/1974 | Hoiles | 206/624 |
| 3,981,434 | 9/1976 | Ramich | 206/624 |

*Primary Examiner*—Stephen P. Garbe

*Attorney, Agent, or Firm*—Robert P. Auber; Ernest L. Brown; Ira S. Dorman

[57] ABSTRACT

A carton particularly adapted for ice cream including a front wall, bottom wall, rear wall, top cover panel, front cover panel, corner glue tabs, cover end skirt panels, rearward and front inner end wall panels, and a pair of end walls, wherein, said end walls have a weakness line separating their outer margins from the lower panels thereof and said cover end skirt panels are glued to said outer margins to break said outer margins away from the lower panels of said end walls when the erected box is opened.

14 Claims, 6 Drawing Figures

FIG. 5
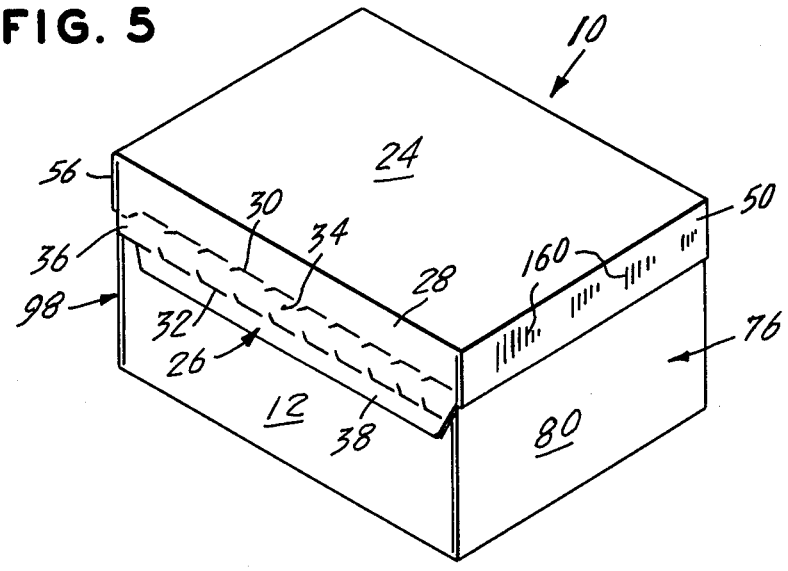
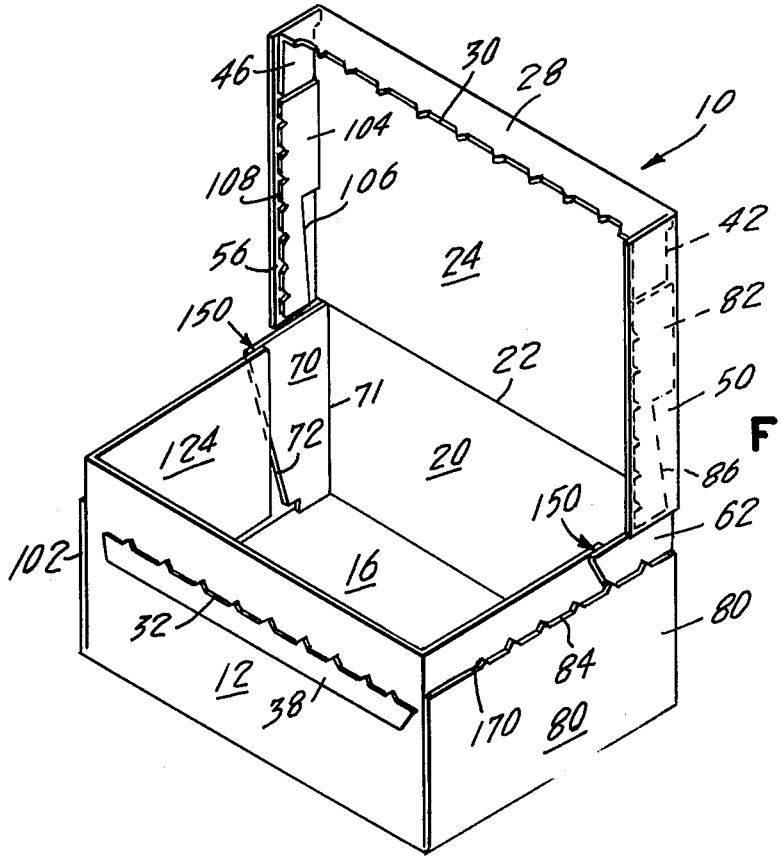
FIG. 6

CARTONS FOR ICE CREAM AND THE LIKE

BACKGROUND OF THE INVENTION

This invention relates to a paperboard carton construction and more particularly to an improved trunk-type folding paperboard carton adapted particularly to carry frozen ice cream, and the like.

Ice cream is commonly packaged for home consumption in trunk-type cartons made from a single, coated paperboard blank having front, bottom, rear and top cover panel together with cover closure flaps in hinged relation to the top cover panel. The carton also has end walls together with overlying inner flaps and embossed and adhesive seals to prevent leakage of the ice cream.

The cover closure flap, sometimes called the front cover panel, and the cover end skirt panels typically have weakened portions to allow the top of the ice cream carton readily to be opened.

It is also typical that only the ends of the cover and skirt panel are glued to the side, thereby producing an opportunity for leakage, particularly if the carton is upside down.

A typical prior art carton is shown in U.S. Pat. No. 3,833,165 which issued Sept. 3, 1974 to Steven North Hoiles. It is assigned to American Can Company.

One of the attempts to remedy the problem of sealing at the cover end skirt panel is shown in U.S. Pat. No. 3,981,434 which issued Sept. 21, 1976 to Gary Allen Ramich for an "Easy Opening Carton for Comestible" and which is assigned to American Can Company. Instead of gluing the end portions of the end skirt panels to the end walls as shown in U.S. Pat. No. 3,833,165, the technique in U.S. Pat. No. 3,981,434 is to glue a portion of the outer margin of the cover end skirt panel to the end wall and to provide a weakened or tear line in that panel. Unfortuantely, with the weakened line in the end skirt panel, printing, embossing and date stamping may open the weakened portion and cause the carton to leak.

SUMMARY OF THE INVENTION

The carton of this invention has a weakened line near the upper edge of the end wall and no weakened line on the end skirt panel. Therefore, the end skirt panel may receive printing, embossing or a date stamp without failing.

The resulting carton has a more rigid cover after opening because the skirt panel is glued to the detached upper margin (above the weak line) of the end wall.

It is therefore an object of this invention to provide an improved carton.

It is still a more specific object of this invention to provide a new and improved trunk-type carton for ice cream and the like.

BRIEF DESCRIPTION OF THE DRAWINGS

Other objects will become apparent from the following description, taken in connection with the accompanying drawings, in which:

FIG. 5 is an oblique view of a closed carton of this invention; and

FIG. 6 is an oblique view of the carton of FIG. 5 after opening, showing the rupture of the weakened lines in the end walls of the carton.

DETAILED DESCRIPTION OF THE INVENTION

Figure 1:
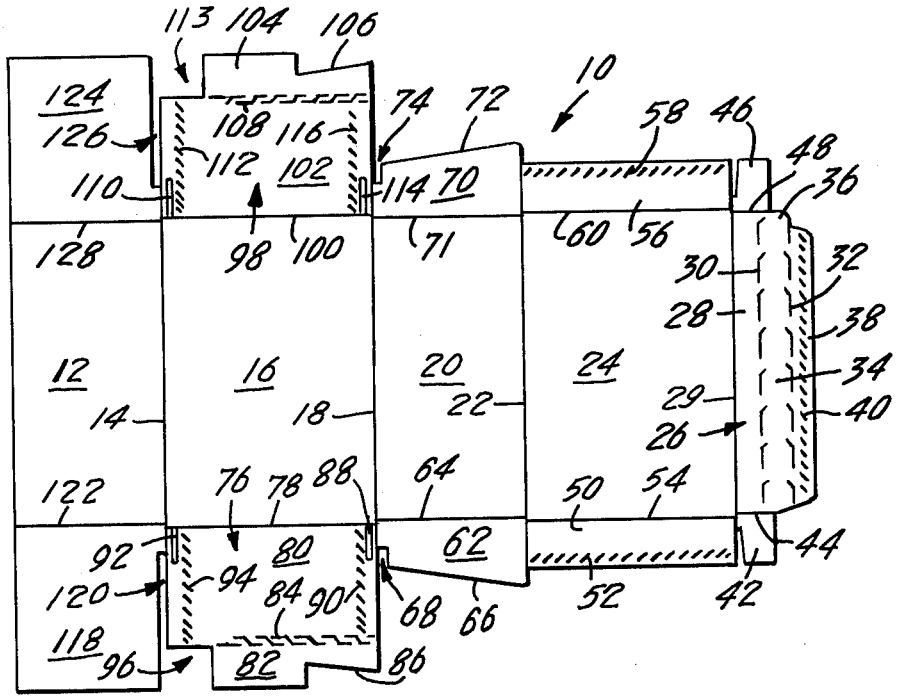
FIG. 1 is a plan view of the interior surface of an improved carton blank.

Referring to the drawings, in particularly FIG. 1 which is a blank of the carton of this invention, the carton 10 has a front wall 12 which is hinged at 14 to a bottom wall 16. The bottom wall 16 is hinged at 18 to a rear wall 20. The rear wall 20 is hinged at 22 to a top cover panel 24. The top cover panel 24 is hinged at 29 to a front cover panel 26.

The front cover panel 26 has a front skirt section 28 adjacent the top cover panel 24, a pair of weakness lines 30 and 32 forming therebetween an intermediate detachable region 34 which is sometimes called a zipper and a lower margin at region 38. One end of the detachable portion 34 has a tab 34 which can be grasphed when opening the package. The lower marginal portion 38 has an adhesive strip 40 along the length thereof.

A pair of cover and skirt panels are attached by hinges 54 and 60 to the ends of top cover panel 24. Each cover end skirt panel 50 and 56 has a glue strip or adhesive 52 and 58 along the outer edges thereof.

The rear wall 20 has a pair of rearward inner end wall panels 62 and 70 hinged to the opposite ends thereof by hinge lines 64 and 71. The outer edges 66 and 72 of the rearward inner end wall panels are inclined or tapered as a paper saving technique. In the preferred embodiment of the invention, the top dimension "E" (FIG. 3) overlaps the front inner end wall panels, and the incline of edges of 66 and 72 is such that the overlap continues downward from the top edge at least a distance "D" (FIG. 3) to avoid leakage.

The bottom wall 16 has a pair of end walls 76 and 98 which when the carton is erected, are upstanding about hinge lines 78 and 100 from the bottom wall 16.

Each of the end walls has a bottom panel 80 and 102 separated from an upper or marginal region 82 and 104 by a weakness or tear line 84 and 108. Embossed patterns 88, 92, 110 and 114 are preferred but optional fluid seals as described particularly in U.S. Pat. No. 3,833,165, which issued Sept. 3, 1974 to Steven North Hoiles for an "End Wall Construction for a Carton" and which is assigned to American Can Company. Adhesive strips 90, 94, 112 and 116 complete the seal.

Figure 2:
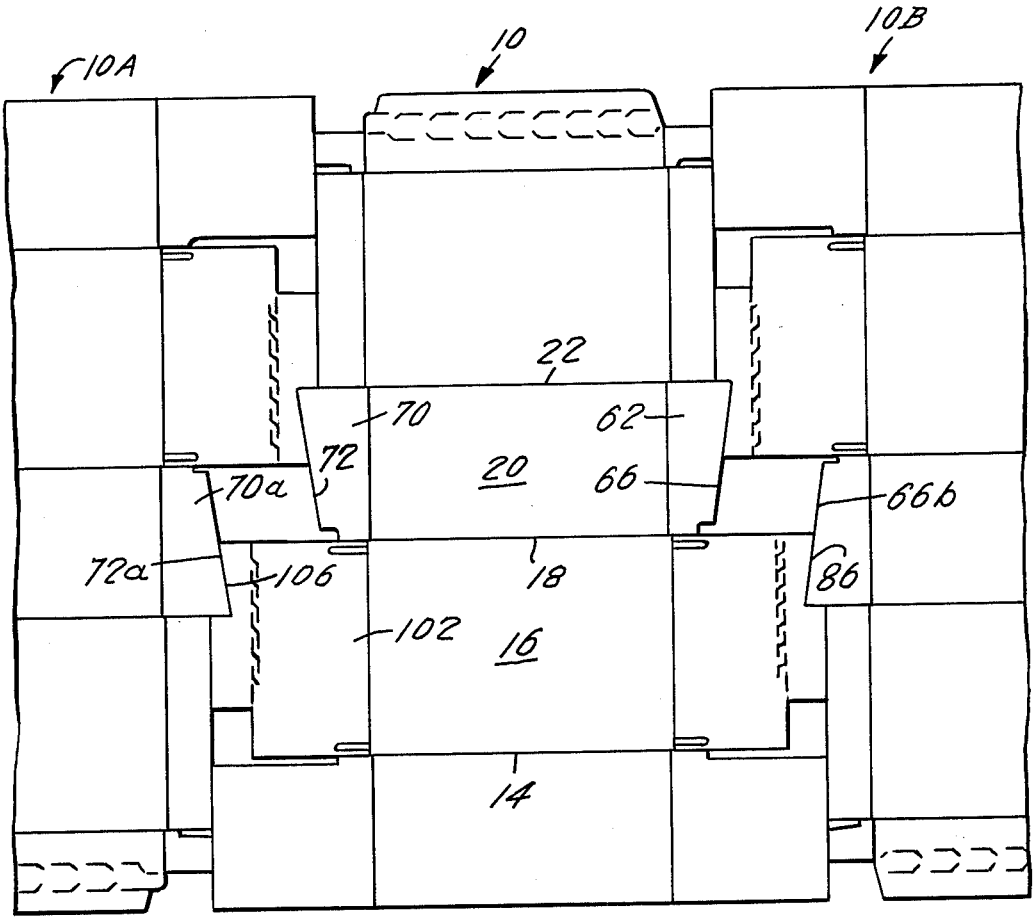
FIG. 2 is a view showing the layout of consecutive blanks on a web of cardboard.

The inclined edges 86 and 106 of the marginal portions 82 and 104 match the inclines 66 and 72. This may be seen particularly in FIG. 2 which is a portion of a web of material from which the blank is made. Note in FIG. 2 how the edges 106 and **72*a*, and 86 and 66*b***, are congruent to save a significant amount of paper in the blank forming process.

The rectangular openings 96 and 113 receive the corner glue tabs 42 and 46 when the carton is erected.

The ends of the front wall 12 have a pair of front inner end wall panels 118 and 124 which are hinged to the front wall at hinge lines 122 and 128. The clearance spaces 68, 74, 120 and 126 facilitate the erecting of the carbon by carton erecting machinery (not shown).

Figure 3:
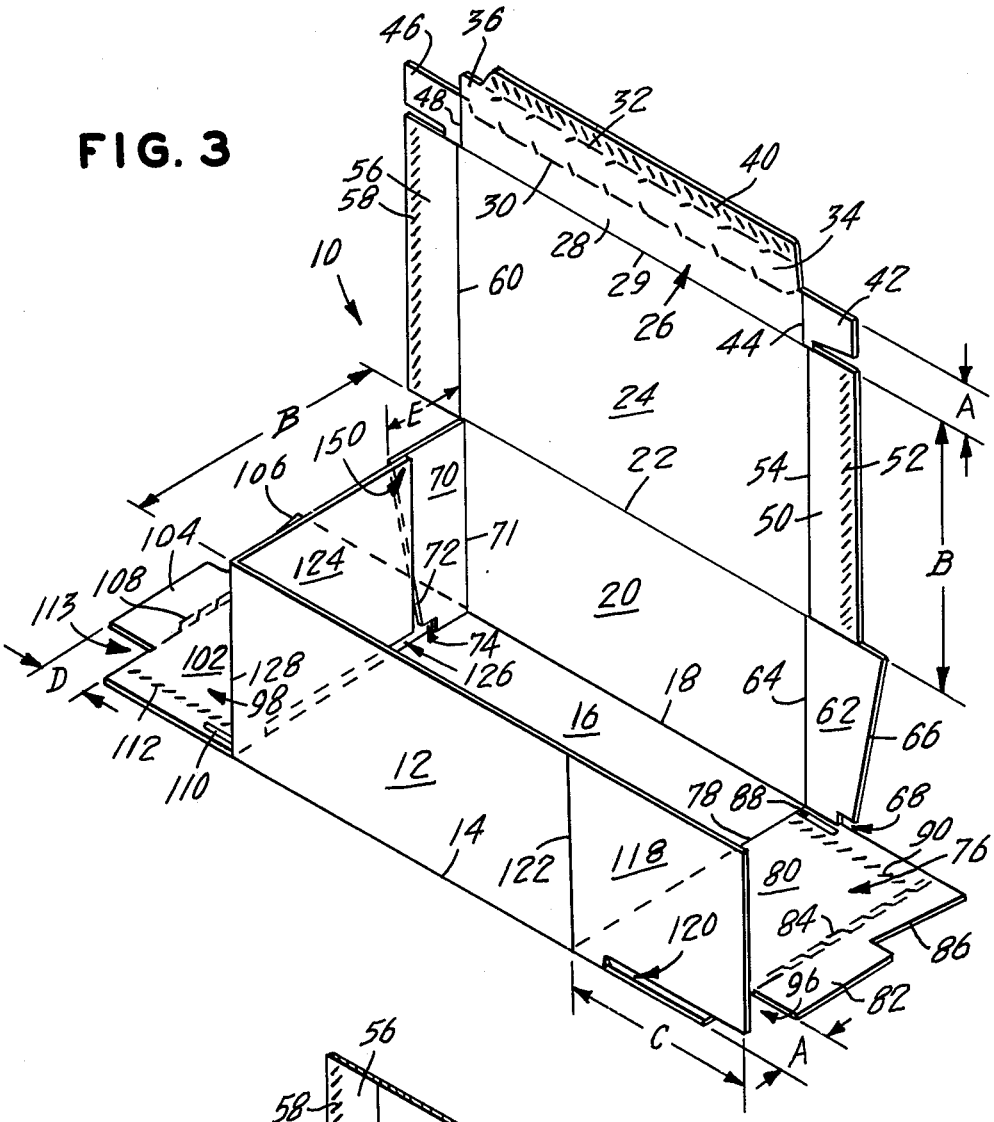
FIG. 3 is an oblique view of a partly-erected carton of this invention.

In the partly erected carton of FIG. 3 the front wall 12 and the back wall 20 have been folded upward about the hinge lines 14 and 18, respectively. The front inner end wall panel 124 has been folded toward the rear of the carton about the hinge line 128. The rearward inner end wall panel 70 has been folded forward about the hinge line 71 to overlap the front inner end wall panel 124 in the region 150. The overlap preferably extends downward at least a distance "D." It follows that the sum of the dimensions "C" and "E" must exceed the dimension "B."

Figure 4:
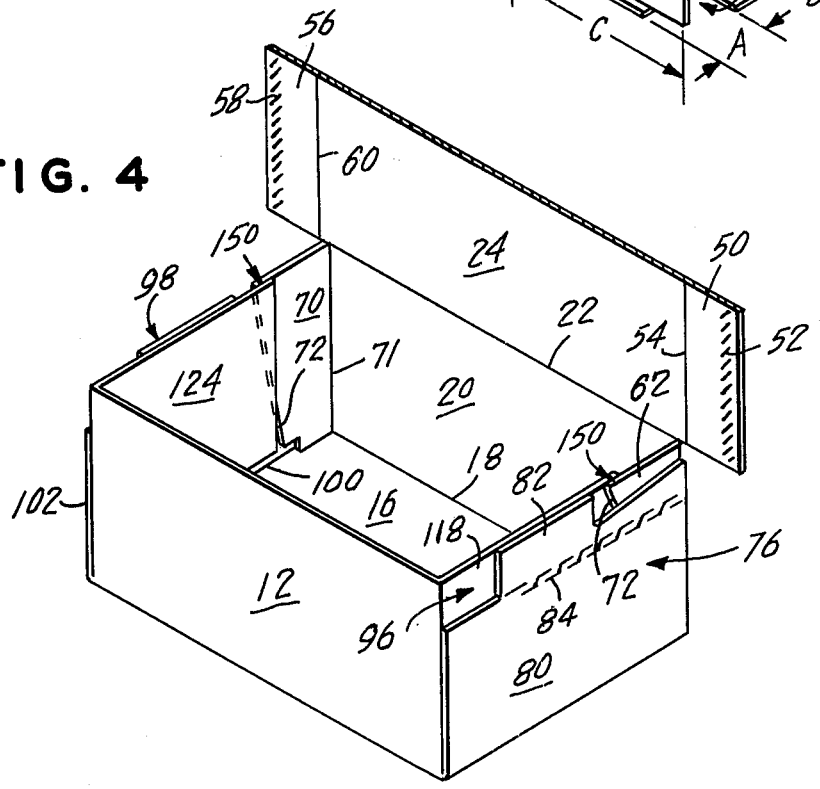
FIG. 4 is an oblique view of a fully-erected carton of this invention preparatory to filling.

FIG. 4 shows a carton erected according to this invention and ready for filling. The inner end wall panels 118 and 62 have also been folded with 62 overlapping 118, and the end walls 76 and 98 have been bent around their hinge lines into an upstanding position. Adhesive strips 90, 94, 112 and 116 on the end walls 76 and 98 seal the carton.

In the closed carton of FIG. 5, the adhesive 40, 52 and 58 hold the top of the carton closed. Because the weakness lines 84 and 108 are on the end walls of the carton, a text 160 may be impressed upon the outside of the cover end skirt panels 50 and 56 without accidentally opening the carton.

To open the carton, as shown in FIG. 6, the tab 36 is pulled to remove the intermediate detachable portion 34, and the cover is lifted. By lifting the cover, the margin region 82 is detached from the lower panel 80 of the end wall 76 and the margin region 104 is detached from the lower panel 102 of the end wall 98. The weakness line 84 and the margin region 82 has a length which extends substantially from the rear edge of the end wall 76 less a distance A substantially equal to the horizontal length of the corner glue tabs. The margin region 104 has the same length as 82, and it starts at point 170. It will be observed that starting the weakness line 84 at the point 170 requires less leverage to open the carton then if the weakness line extended all of the way to the front of the carton. Note also that the top is reinforced by the margin regions 82 and 104.

There has thus been provided a novel carton particularly for ice cream which has the end of the carton weakness line for opening thereof on the end walls rather than on the cover, whereby the cover end skirt panels may be attached with a full length of adhesive 52 or 58 and whereby embossing or lettering may be applied to the outside of such panels without fracturing the weakness lines.

A further advantage of a preferred embodiment is that the contour of the rearward inner end wall panels reduces the amount of needed paperboard to produce a substantial saving when the carton is produced in large quantities.

Although the invention has been described in detail above, it is not intended that the invention should be limited to that specification but only by the specification taken together with the accompanying claims.

I claim:

1. In a paperboard carton for ice cream having an upstanding front wall, a bottom wall hinged to said front wall, an upstanding rear wall hinged to said bottom wall, a top cover panel hinged to the top of said rear wall, a front cover panel downwardly hinged to the front edge of said top cover panel and overlapping the upper portion of said front wall when the carton is closed, said front cover panel having regions separated by a pair of spaced upper and lower weakness lines substantially parallel to the hinge line between said top cover panel and said front cover panel into an upper cover front skirt region, an intermediate detachable region, and a lower margin region adhesively attachable to the outside of said front wall, a pair of corner glue tabs rearwardly hinged to opposite ends of said front cover panel, a pair of cover end skirt panels downwardly hinged to opposite ends of said top cover panel, a pair of rearward inner end wall panels forwardly hinged to opposite ends of said rear wall, a pair of front inner end wall panels rearwardly hinged to opposite ends of said front wall, and a pair of upstanding end walls hinged to opposite ends of said bottom wall, the improvement comprising:

each said end wall having a weakness line substantially parallel to its hinge line and dividing each said end wall into two regions, an upper margin region and a lower end panel adjacent said bottom wall.

2. The carton of claim 1 in which each said end panel has a pair of substantially vertical glue lines thereon positioned near the front and rear edges of said end panels and extending substantially from said hinge lines to said weakness lines.

3. The carton of claim 2 in which said margin regions of said end walls have a vertical height substantially equal to the vertical height of said cover end skirt panels.

4. The carton of claim 3 in which said margin regions of said end walls have lengths which extend substantially from the rearward edges of said end walls to the front edges of said end walls less a distance substantially equal to the horizontal length of said corner glue tabs.

5. The carton of claim 4 in which at least the upper regions of said rearward inner end wall panels each overlap the upper region of an adjacent said front inner end wall panel, the vertical height of said regions of overlap being at least equal to the vertical height of said margin regions of said end walls and said cover end skirt panels.

6. The carton of claim 5 and further comprising an adhesive strip along the outer edges of the inside of each of said cover end skirt panels for their entire length from the front to the rear thereof for adhesive bonding to said corner glue tabs and to said outer margin regions of said end walls.

7. A carton comprising:

an upstanding front wall;

a bottom wall hinged to said front wall;

an upstanding rear wall hinged to said bottom wall;

a top cover panel hinged to the top of said rear wall;

a front cover panel downwardly hinged to the front edge of said top cover panel and overlapping the upper region of said front wall when the carton is closed, said front cover panel having regions separated by a pair of spaced upper and lower weakness lines substantially parallel to the hinge line between said top cover panel and said front cover panel into an upper cover front skirt region, an intermediate detachable region, and a lower margin region adhesively attachable to the outside of said front wall;

a pair of corner glue tabs rearwardly hinged to opposite ends of said front cover panel;

a pair of cover end skirt panels downwardly hinged to the ends of said top cover panel;

a pair of rearward inner end wall panels forwardly hinged to the ends of said rear wall;

a pair of front inner end wall panels rearwardly hinged to opposite ends of said front wall;

a pair of upstanding end walls hinged to opposite ends of said bottom wall, each said end wall having a weakness line substantially parallel to its hinge line and dividing each said end wall into two regions, an upper margin region and a lower end panel adjacent said bottom wall.

8. The carton of claim 7 in which said end panels on said end walls have a pair of substantially vertical adhesive lines thereon positioned near the front and back edges of said end panels and extending substantially from their said hinge lines to said weakness lines on said end panels.

9. The carton of claim 8 in which said margin regions of said end panels have a vertical height substantially equal to the vertical height of said cover end skirt panels.

10. The carton of claim 9 in which said margin regions of said end walls have lengths which extend substantially from the rearward edges of said end walls to the front edges of said end walls less a distance substantially equal to the horizontal length of said corner glue tabs.

11. The carton of claim 10 in which at least the upper regions of said rearward inner end panels each overlap the upper region of said adjacent front inner end wall panel, the vertical height of said regions of overlap being at least equal to the vertical height of said margin regions of said end walls and said cover end skirt panels.

12. The carton of claim 11 and further comprising an adhesive strip along the outer edges of the inside of each of said cover end skirt panels for their entire length from the front to the rear thereof for adhesive bonding to said corner glue tabs and to said outer margin regions of said end walls.

13. The carton of claim 11 in which the front to rear widths of said rearward inner end wall panels taper from a maximum dimension at the top to a minimum dimension at the bottom thereof, said taper being limited by the requirement that their upper regions overlap the upper regions of their adjacent said front inner end wall panels.

14. A carton blank in a series of blanks, each symmetrical about centerlines in a first direction comprising:

a first rectangular panel having its short edges in said first direction (12);

a second rectangular panel, having its short edges in said first direction (16), attached by a hinge line (14) on a first longer edge to a first longer edge of said first panel (12);

a third rectangular panel (20), having its short edges in said first direction, attached by a hinge line (18) on a first longer edge to a second longer edge of said second panel (16);

a fourth rectangular panel, having its short edges in said first direction (24), attached by a hinge line (22) on a first longer edge to a second longer edge of said third panel (20);

a fifth substantially rectangular front cover panel, having its short edges in said first direction (26), attached by a hinge line (29) on a first longer edge to a second longer edge of said fourth panel, having a detachable region along its longer length with one end thereof having a graspable tab, having a lower margin (38) external of said detachable region and shorter than said fifth panel, and having an adhesive strip along its length;

corner glue tabs (42, 46) attached by hinge lines (44, 48) to the ends of said fifth panel (26);

rectangular cover end skirt panels (50, 56) attached on longer edges thereof and hinge lines (54, 60) to the shorter edges of said fourth panel (24), and each having an adhesive strip on the outer edges thereof;

rearward inner end wall panels (62, 70) each attached on one of its longer edges on hinge lines (64, 71) to the shorter edges of said third panel (20), each of the outer edges (66, 72) of said end wall panels (62, 70) being inclined relative to its inner edges (64, 71) to match the contours of a next adjacent blank in said series of blanks;

end wall panels (76, 98) each having a rectangular bottom panel (80, 102) separated from upper marginal regions (82, 104) by tear lines (84, 108) and each attached on its longer edge by hinge lines (78, 100) to said second panel (16), the outer edges (86, 106) of said upper marginal regions being parallel to the outer edges (66, 72) of said end wall panels (62, 70) over approximately half of the length of said outer edges to match the contours of a next adjacent blank in said series of blanks, each of said marginal regions (82, 104) being shortened to produce an opening (96, 113); and a pair of substantially rectangular front end panels (118, 129) each hinged along one edge (122, 128) to the short edges of said first panel.

* * * * *